US006832683B2

(12) United States Patent
Boriani et al.

(10) Patent No.: US 6,832,683 B2
(45) Date of Patent: Dec. 21, 2004

(54) RIGID CARTON OF CIGARETTES PARTIALLY OPENABLE FOR DISPLAY

(75) Inventors: Silvano Boriani, Bologna (IT); Fiorenzo Draghetti, Medicina (IT)

(73) Assignee: G.D Societa per Azioni, Bologna (IT)

( * ) Notice: Subject to any disclaimer, the term of this patent is extended or adjusted under 35 U.S.C. 154(b) by 0 days.

(21) Appl. No.: 10/121,793

(22) Filed: Apr. 12, 2002

(65) Prior Publication Data

US 2002/0175095 A1 Nov. 28, 2002

Related U.S. Application Data

(63) Continuation of application No. PCT/IT00/00410, filed on Oct. 13, 2000.

(30) Foreign Application Priority Data

Oct. 14, 1999 (IT) ..... BO99A000552

(51) Int. Cl.[7] ..... B65D 85/10

(52) U.S. Cl. ..... 206/273; 206/736; 206/264; 206/526; 229/235; 229/237; 229/242; 229/120.011

(58) Field of Search ..... 206/273, 271, 206/274, 275, 276, 256, 264, 736, 774, 746; 229/235, 237, 240, 241, 242, 164, 120.011

(56) References Cited

U.S. PATENT DOCUMENTS 3,071,244 A * 1/1963 Doran ..... 206/45.29
3,531,045 A 9/1970 Johnson
3,917,158 A * 11/1975 Dorofachuk et al. ..... 229/241
4,058,206 A * 11/1977 Morse et al. ..... 229/241
4,141,449 A * 2/1979 Stone ..... 229/223
5,419,431 A * 5/1995 Neuber et al. ..... 206/256
5,439,106 A * 8/1995 Focke ..... 206/273
5,651,497 A 7/1997 Ventura et al.

FOREIGN PATENT DOCUMENTS

| | | |
|---|---|---|
| DE | 295 18 315 | 2/1996 |
| FR | 2669893 | 6/1992 |
| GB | 2321238 | 7/1998 |

* cited by examiner

*Primary Examiner*—J. Mohandesi
(74) *Attorney, Agent, or Firm*—Marshall, Gerstein & Borun LLP

(57) ABSTRACT

A rigid parallelepiped-shaped carton (1) for packets (3) of cigarettes is disclosed. The carton has a cup-shaped bottom container (8) and a substantially cup-shaped top lid (9) connected to the bottom container (8) along at least one preweakened tear line (10) running along two parallel, facing vertical lateral walls (11, 12), and along a vertical front wall (13), so as to divide each vertical wall (11, 12, 13) into a respective bottom portion (**11*a*, 12*a*, 13*a*) forming part of the container (8), and a respective remaining top portion (11*b*, 12*b*, 13*b*) forming part of the lid (9); each packet (3) of cigarettes being housed inside the carton (1) with a major lateral wall (5) of the packet parallel to the front wall (13); and the preweakened tear line (10) being located at a first height (H1) along the vertical lateral walls (11, 12) and dropping to a second height (H2), lower than the first height (H1), along the vertical front wall (13**).

9 Claims, 3 Drawing Sheets

RIGID CARTON OF CIGARETTES PARTIALLY OPENABLE FOR DISPLAY

CROSS-REFERENCE TO RELATED APPLICATION

This application is a continuation of PCT application Ser. No. PCT/IT00/00410, filed Oct. 13, 2000, pending.

TECHNICAL FIELD

The present invention relates to a rigid carton of cigarettes partially openable for display.

More specifically, the present invention relates to a rigid carton of cigarettes made from a flat cardboard blank and containing a group of ten packets of cigarettes.

BACKGROUND ART

The end user of a carton of cigarettes is normally a retailer who simultaneously uses, and removes individual packets for sale, from a number of different open cartons (of different brands and/or types of cigarettes). The present invention relates to a carton of cigarettes usable as a display. Many cartons usable as a display have been suggested in the prior art such as in U.S. Pat. No. 5,651,497, U.S. Pat. No. 3,531,045 and GB 2,321,238. Nevertheless, the cartons disclosed in the prior art do not have the requirements for being used in the field of cigarettes. Usually the cartons of cigarettes are of the utmost quality and, at the same time, have to be produced at the highest speed possible. The cartons disclosed in the prior art, on the one side, have at least some walls made of abutting panels, which undermine the esthetical appearance and the stability of the cartons and, on the other side, are made from a blank having many portions to be glued and many folds to be done to such an extent to slow down the packaging process.

DISCLOSURE OF INVENTION

It is an object of the present invention to provide a rigid carton of cigarettes designed to permit a clear view of the type of packets contained inside, as well as troublefree withdrawal and adequate retention of the packets themselves.

According to the present invention, there is provided a rigid carton of cigarettes; the carton being parallelepiped-shaped and comprising a cup-shaped bottom container for supporting a group of packets of cigarettes, and a top lid; wherein the lid is substantially cup-shaped and connected to the bottom container along at least one preweakened tear line running along two parallel, facing vertical lateral walls, and along a vertical front wall, so as to divide each vertical wall into a respective bottom portion forming part of the container, and a respective remaining top portion forming part of the lid; each packet of cigarettes being housed inside the carton with a major lateral wall of the packet parallel to said front wall; and the preweakened tear line being located at a first height along the vertical lateral walls and dropping to a second height, lower than the first height, along the vertical front wall; said carton being formed from a flat blank; the carton being characterized in that said blank has two longitudinal bend lines, and a number of transverse bend lines defining, between said two longitudinal bend lines, a first panel corresponding to a bottom wall of the carton, a second panel corresponding to a first lateral wall of the carton, a third panel corresponding to a top wall of the carton, and a fourth panel corresponding to a second lateral wall of the carton; said fourth panel having a first wing and a second wing located on opposite sides of the fourth panel and respectively corresponding to a front wall and a rear wall of the carton; and said second and fourth panel and said first wing comprising respective portions of said preweakened tear line.

BRIEF DESCRIPTION OF THE DRAWINGS

A number of non-limiting embodiments of the present invention will be described by way of example with reference to the accompanying drawings, in which.

BEST MODE FOR CARRYING OUT THE INVENTION

Figure 1:
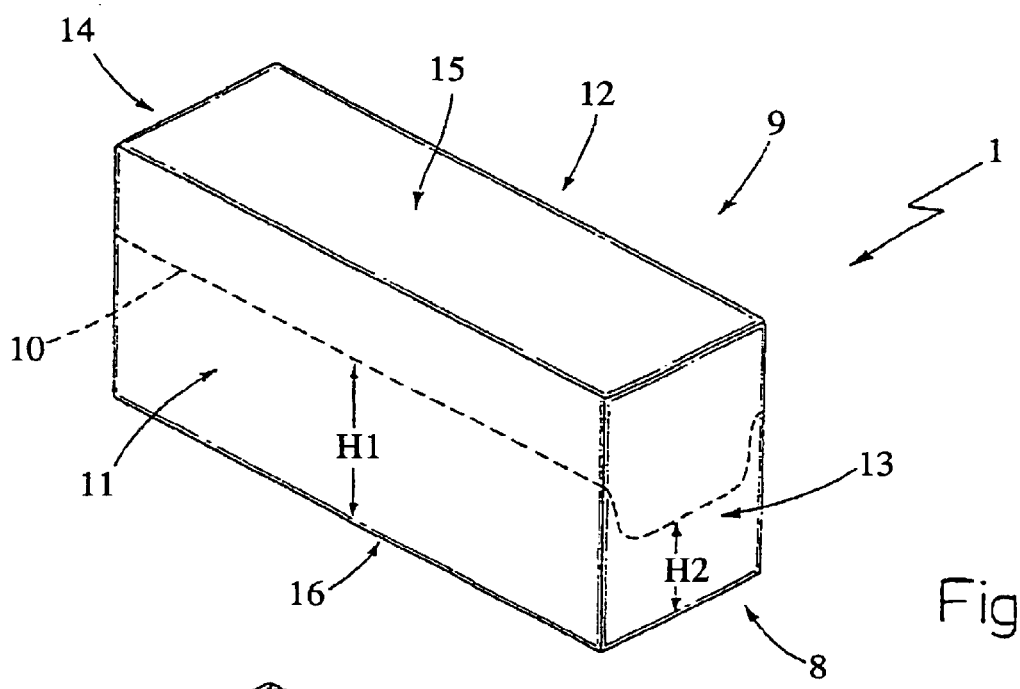
FIG. 1 shows a front view in perspective of a preferred embodiment of the carton according to the present invention in a closed configuration.
Figure 2:
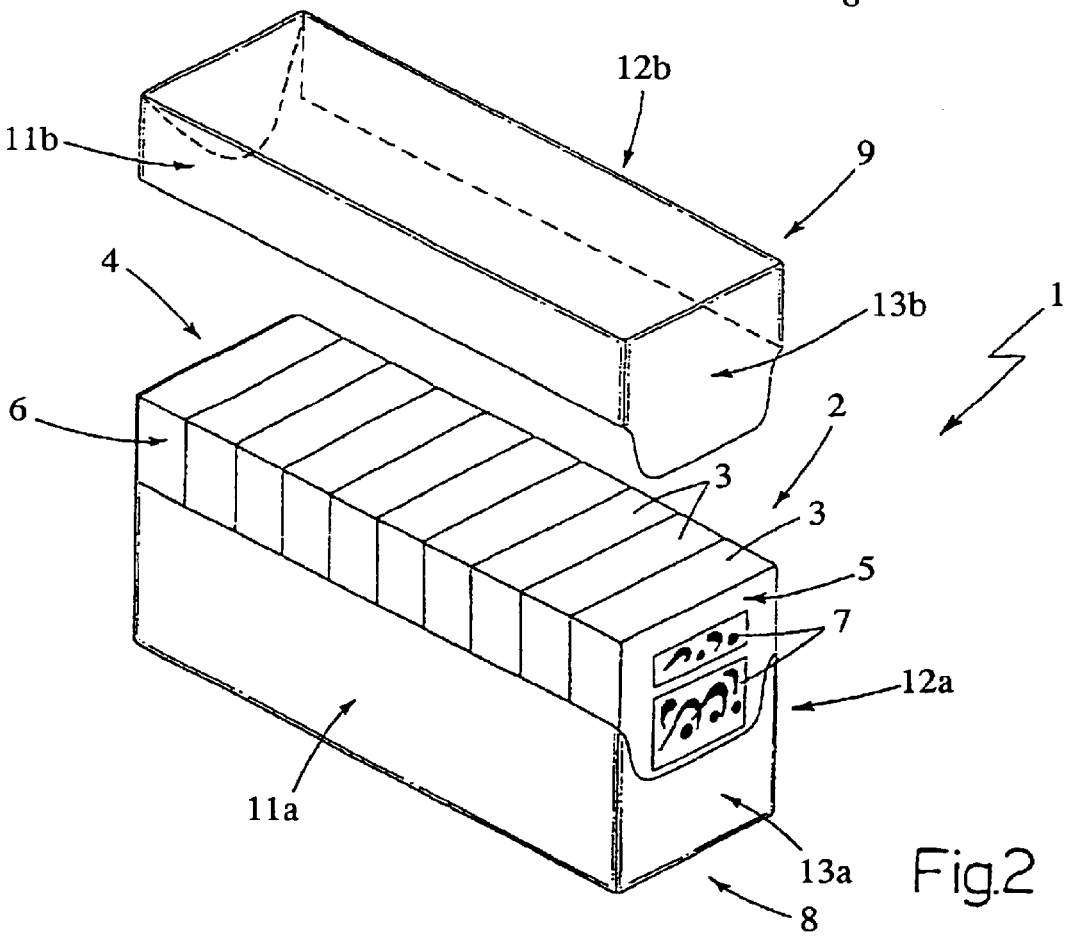
FIG. 2 shows a front view in perspective of the FIG. 1 carton in an open configuration.

Number 1 in FIGS. 1 and 2 indicates as a whole a rigid carton containing a group 2 of ten packets 3 of cigarettes arranged in one row 4. Each packet 3 is substantially parallelepiped-shaped, and comprises two vertical, parallel, facing major lateral walls 5 (only one wall 5 of the first packet 3 is shown partly in FIG. 2), and two vertical, parallel facing minor lateral walls 6 (only one wall 6 of each packet 3 is shown partly in FIG. 2). Packets 3 in row 4 are arranged with respective major lateral walls 5 contacting one another; and each major lateral wall 5 has respective writing and/or a respective graphic element 7 clearly and unmistakably indicating the brand and characteristics of the cigarettes (not shown) inside respective packet 3.

Figure 4:
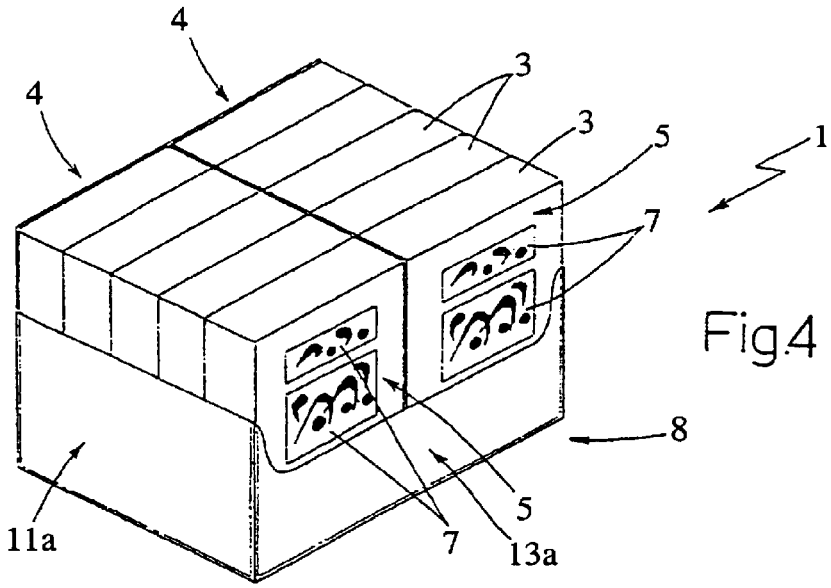
FIG. 4 shows a front view in perspective of an alternative embodiment of the carton according to the present invention in an open configuration.

In an alternative embodiment shown in FIG. 4, the ten packets 3 of cigarettes in group 2 are arranged in two identical, side by side rows 4.

Carton 1 is substantially right-parallelepiped-shaped, and comprises a cup-shaped bottom container 8 for supporting group 2 of packets 3, and a substantially cup-shaped top lid 9 connected to bottom container 8 along a preweakened tear line 10 and detachable from container 8 to enable carton 1 to assume a closed configuration (FIG. 1) and an open configuration (FIG. 2).

When lid 9 is in the closed configuration, carton 1 is substantially in the form of a right parallelepiped defined by a pair of parallel, facing vertical lateral walls 11 and 12 (only wall 11 shown in FIGS. 1 and 2), a vertical front wall 13, a vertical rear wall 14 (not shown in FIGS. 1 and 2), a horizontal top wall 15, and a horizontal bottom wall 16 (not shown in FIGS. 1 and 2).

Preweakened line 10 runs along the two lateral walls 11 and 12 and along front wall 13 to divide each wall 11, 12, 13 into a respective bottom portion 11*a*, 12*a*, 13*a* forming part of container 8, and into a respective remaining top portion 11*b*, 12*b*, 13*b* forming part of lid 9. Rear wall 14 and bottom wall 16 are exclusive to container 8, and top wall 15 exclusive to lid 9.

As shown in FIG. 2, packets 3 in row 4 are arranged with major lateral walls 5 positioned vertically and parallel to front wall 13 of carton 1; and the first packet 3 in row 4 is positioned with a major lateral wall 5 directly contacting an inner surface of front wall 13.

As shown in FIGS. 1 and 2, preweakened line 10 is located at a first height H1 along lateral walls 11 and 12, and drops to a second height H2, lower than first height H1, along front wall 13, so that portions 11*a* and 12*a* of container 8 have much larger surfaces than the corresponding portions lib and 12*b* of lid 9, and portion 13*a* of container 8 has a surface comparable with that of portion 13*b* of lid 9.

As shown in FIG. 2, the shape and size of portion 13*a* allow a clear view of the writing and/or graphic element 7 of the first packet 3 in row 4; each packet 3 may be removed easily from container 8, by portions 11*a* and 11*b* being lower than minor lateral walls 6 of packets 3 and so permitting easy grip of packets 3 by the user; and the relatively high surfaces of portions 11*b* and 12*b* provide for adequately retaining packets 3 even when fewer than the initial number.

Carton 1 is therefore easy to store, transport and handle in the closed configuration (FIG. 1) and, when opened by detaching lid 9 from container 8 (FIG. 2), allows a clear view of the type of packets 3 inside, and provides for easy withdrawal and adequate retention of packets 3.

Figure 5:
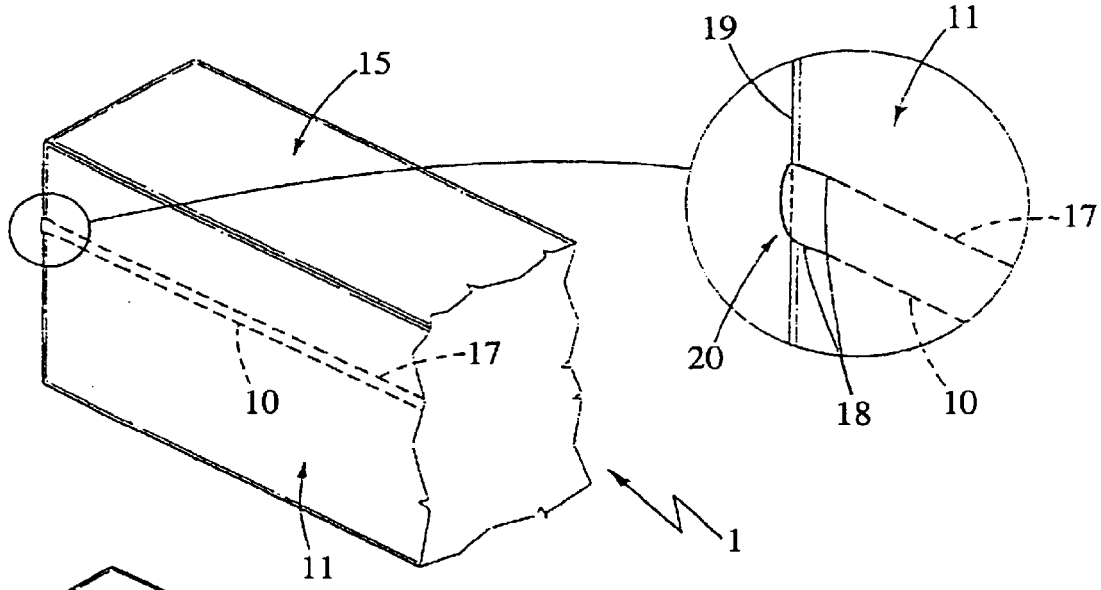
FIG. 5 shows different embodiments of a detail of the FIG. 1 carton.
Figure 5:
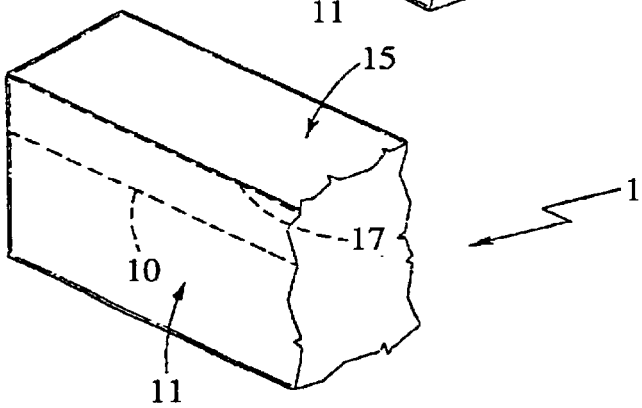

In an alternative embodiment shown in FIG. 5, carton 1 comprises a further preweakened tear line 17 running parallel to and above preweakened line 10 along at least a portion of lateral wall 11, so as to define a tear-off strip by which to tear open carton 1 easily.

More specifically, as shown in the enlarged detail in FIG. 5, preweakened tear lines 10 and 17 comprise respective initial portions 18, which are detached and located side by side close to an outer edge 19 of lateral wall 11 to define a tear-off tongue 20.

In the FIG. 5 embodiment, line 17 runs parallel to line 10 along the edge between lateral wall 11 and top wall 15.

In an alternative embodiment not shown, line 17 runs parallel to and above preweakened line 10 along the whole of lateral wall 11; and, in a further embodiment not shown, line 17 runs parallel to and above preweakened line 10 along the whole lateral walls 11 and 12 and front wall 13.

Figure 3A:
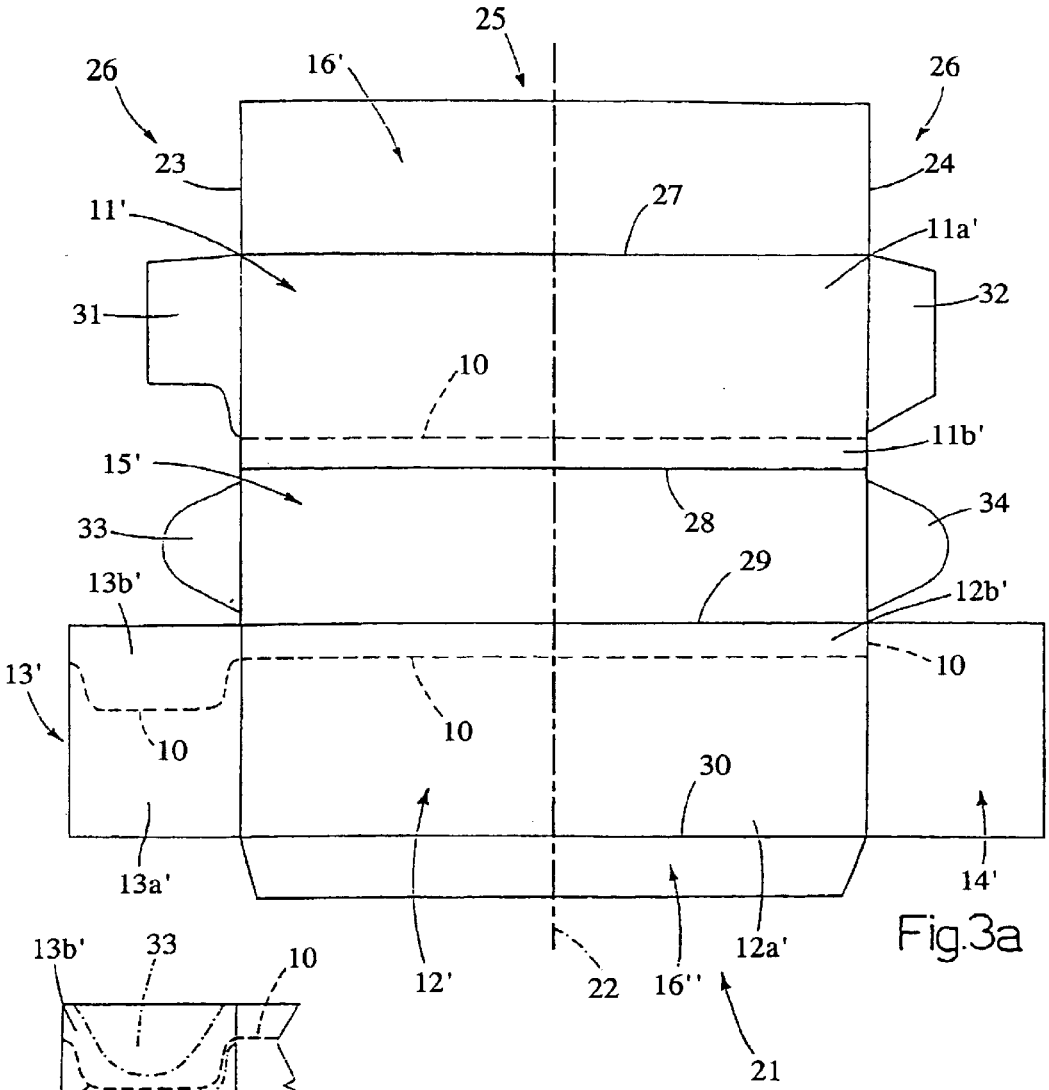
FIG. 3*a* shows a layout of a blank used to form the FIG. 1 carton.

As shown in FIG. 3, carton 1 in FIGS. 1 and 2 is formed from a corresponding flat blank 21, which is substantially in the form of an elongated rectangle, and the parts of which are indicated, wherever possible, using the same reference numbers, with superscripts, as for the corresponding parts of carton 1.

Blank 21 comprises a longitudinal central axis 22, and two longitudinal bend lines 23 and 24 dividing blank 21 into a central longitudinal strip 25 and two lateral longitudinal strips 26. Strips 25 and 26 are crossed by a number of transverse bend lines 27, 28, 29, 30, which divide central strip 25 into a panel 16' extending between an outer edge of blank 21 and line 27, a panel 11' extending between lines 27 and 28, a panel 15' extending between lines 28 and 29, a panel 12' extending between lines 29 and 30, and a tongue 16" extending between line 30 and an outer edge of blank 21.

When forming carton 1, panel 16' and tongue 16" are superimposed and glued together to define bottom wall 16 of carton 1.

Panel 12' comprises a wing 131 and a wing 14' located on opposite sides of panel 12'; and, as shown in FIG. 3, panels 11' and 12' and wing 13' comprise respective portions of preweakened tear line 10.

Panel 12' is divided by the respective portion of preweakened line 10 into a portion 12*a'* forming part of container 8, and a remaining portion 12*b'* forming part of lid 9; wing 14' is connected to portion 12*a'* by a portion of respective longitudinal bend line 24, and is connected to portion 12*b'* by a longitudinal portion of the respective portion of preweakened line 10.

Panel 11' is divided by the respective portion of preweakened line 10 into a portion 11*a'* forming part of container 8, and a remaining portion 11*b'* forming part of lid 9; and portion 11*a'* forming part of container 8 is joined to lateral tongues 31 and 32 located on opposite sides of panel 11' and which are superimposed on and glued respectively to wings 13' and 14' to define walls 13 and 14 of carton 1.

Panel 15' comprises substantially rounded lateral tongues 33 and 34 located on opposite sides of panel 15' and which are superimposed respectively on wings 13' and 14' to define walls 13 and 14 of carton 1. Tongue 34 is superimposed on but not connected (in particular, not glued) to wing 14', in that wing 14' forms part of container 8, and tongue 34 part of lid 9.

Figure 3B:
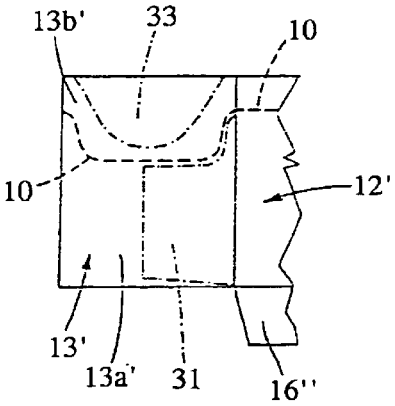
FIG. 3*b* is a detail from FIG. 3*a*;—, to provide a brief description of FIG. 3*b*.

As shown in FIG. 3*b*, wing 13' is divided by the respective portion of preweakened line 10 into a portion 13*a'* forming part of container 8, and a remaining portion 13*b'* forming part of lid 9; tongue 33 is superimposed on and glued to portion 13*b'*; tongue 31 is superimposed on and glued to portion 13*a'*; and tongues 31 and 33 are so shaped and sized as not to overlap preweakened line 10.

What is claimed is:

1. A rigid carton of cigarettes, the carton (1) being parallelepiped-shaped and comprising a cup-shaped bottom container (8) for supporting a group (2) of packets (3) of cigarettes, and a top lid (9); wherein the lid (9) is substantially cup-shaped and connected to the bottom container (8) along at least one preweakened tear line (10) running along two parallel, facing vertical lateral walls (11, 12), and along a vertical front wall (13), so as to divide each vertical wall (11, 12, 13) into a respective bottom portion (11*a*, 12*a*, 13*a*) forming part of the container (8), and a respective remaining top portion (11*b*, 12*b*, 13*b*) forming part of the lid (9); each packet (3) of cigarettes being housed inside the carton (1) with a major lateral wall (5) of the packet parallel to said front wall (13); and the preweakened tear line (10) being located at a first height (H1) along the vertical lateral walls (11, 12) and dropping to a second height (H2), lower than the first height (H1), along the vertical front wall (13); said carton being formed from a flat blank (21); the carton being characterized in that said blank (21) has two longitudinal bend lines (23, 24), and a number of transverse bend lines (27, 28, 29, 30) defining, between said two longitudinal bend lines (23, 24), a first panel (16') corresponding to a bottom wall (16) of the carton (1), a second panel (11') corresponding to a first lateral wall (11) of the carton (1), a third panel (15') corresponding to a top wall (15) of the carton (1), and a fourth panel (12') corresponding to a second lateral wall (12) of the carton (1); said fourth panel (12') having a first wing (13') and a second wing (14') located on opposite sides of the fourth panel (12') and respectively corresponding to a front wall (13) and a rear wall (14) of the carton (1); and said second and fourth panel (11', 12') and said first wing (13') comprising respective portions of said preweakened tear line (10).

2. The carton of claim 1 wherein each said packet (3) of cigarettes is parallelepiped-shaped, and comprises two vertical major lateral walls (5) and two vertical minor lateral walls (6); said group (2) of packets (3) of cigarettes comprising one row (4) of packets (3) arranged with respective major lateral walls (5) contacting one another.

3. The carton of claim 1 wherein each said packet (3) of cigarettes is substantially parallelepiped-shaped, and comprises two vertical major lateral walls (5) and two vertical minor lateral walls (6) said group of packets (3) of cigarettes comprising two side by side rows (4) of packets (3); and the packets (3) in the same row (4) being arranged with respective major lateral walls (5) contacting one another.

4. The carton of claim 1 comprising a vertical rear wall (14), which is substantially devoid of said preweakened tear line (10) and is exclusive to said bottom container (8).

5. The carton of claim 1 comprising a bottom and a top preweakened tear line (10, 17) parallel to each other.

6. The carton of claim 4 wherein said preweakened tear lines (10, 17) comprise respective initial portions (18), which are detached and located side by side close to an outer edge (19) of a said lateral wall (11).

7. The carton of claim 1 wherein said fourth panel (12') is divided by the respective said portion of the preweakened tear line (10) into a first portion (12*a*') forming part of said bottom container (8), and a second portion (12*b*') forming part of said top lid (9); said second wing (14') being connected along a portion of the respective longitudinal bend line (24) to the first portion (12*a*') of the fourth panel (12'), and being connected along a further portion of said preweakened tear line (10) to the second portion (12*b*') of the fourth panel (12').

8. The carton of claim 1 wherein said second panel (11') is divided by the respective said portion of the preweakened tear line (10) into a first portion (11*a*') forming part of said bottom container (8), and a second portion (11*b*') forming part of said top lid (9); the first portion (11*a*') of the second panel (11') having respective lateral tongues (31, 32).

9. The carton of claim 1 wherein said third panel (15') has respective substantially rounded lateral tongues (33, 34).

* * * * *

UNITED STATES PATENT AND TRADEMARK OFFICE

CERTIFICATE OF CORRECTION

PATENT NO. : 6,832,683 B2
DATED : December 21, 2004
INVENTOR(S) : Silvano Boriani et al.

It is certified that error appears in the above-identified patent and that said Letters Patent is hereby corrected as shown below:

Title page,
Item [73] Assignee, "Societa" should be -- Societa' --

Column 5,
Line 4, "(6)" should be -- (6) ; --

Signed and Sealed this

Seventh Day of June, 2005

JON W. DUDAS
*Director of the United States Patent and Trademark Office*